US008945358B2

(12) United States Patent
Woltering et al.

(10) Patent No.: US 8,945,358 B2
(45) Date of Patent: Feb. 3, 2015

(54) ELECTROLYSIS CELL

(75) Inventors: Peter Woltering, Neuenkirchen (DE); Karl Heinz Dulle, Olfen (DE); Randolf Kiefer, Gelsenkirchen (DE); Stefan Oelmann, Hemer (DE); Ulf-Steffen Bäumer, Dormund (DE)

(73) Assignee: Uhdenora S.p.A., Milan (IT)

( * ) Notice: Subject to any disclaimer, the term of this patent is extended or adjusted under 35 U.S.C. 154(b) by 535 days.

(21) Appl. No.: 12/311,309

(22) PCT Filed: Sep. 27, 2007

(86) PCT No.: PCT/EP2007/060268
§ 371 (c)(1),
(2), (4) Date: Mar. 25, 2009

(87) PCT Pub. No.: WO2008/037770
PCT Pub. Date: Apr. 3, 2008

(65) Prior Publication Data

US 2009/0236220 A1 Sep. 24, 2009

(30) Foreign Application Priority Data

Sep. 29, 2006 (DE) ..... 10 2006 046 807
Sep. 29, 2006 (DE) ..... 10 2006 046 808

(51) Int. Cl.
*C25B 11/02* (2006.01)
*C25B 1/46* (2006.01)

(52) U.S. Cl.
CPC .. *C25B 11/02* (2013.01); *C25B 1/46* (2013.01)
USPC ..... 204/288.3

(58) Field of Classification Search
CPC ..... C25B 1/14; C25B 1/16; C25B 1/24; C25B 1/245; C25B 1/26; C25B 1/265; C25B 1/34; C25B 1/46; C25B 9/08; C25B 11/02; C25B 15/04
USPC ..... 204/252, 253, 286.1–288.6, 204/297.01–297.16; 205/617–639
See application file for complete search history.

(56) References Cited

U.S. PATENT DOCUMENTS

| | | | | | |
|---|---|---|---|---|---|
| 3,898,149 | A | * | 8/1975 | Kircher et al. | 204/252 |
| 4,401,530 | A | | 8/1983 | Clere | |
| 4,464,242 | A | * | 8/1984 | Boulton | 204/253 |
| 4,469,577 | A | | 9/1984 | Schmitt | |
| 4,526,663 | A | * | 7/1985 | Yoshida et al. | 205/525 |
| 4,561,959 | A | * | 12/1985 | Pimlott | 204/253 |
| 4,605,482 | A | * | 8/1986 | Shiragami et al. | 204/258 |

(Continued)

FOREIGN PATENT DOCUMENTS

JP 57 013186 A 1/1982

*Primary Examiner* — James Lin
*Assistant Examiner* — Ciel Thomas
(74) *Attorney, Agent, or Firm* — Lucas & Mercanti, LLP

(57) ABSTRACT

The invention relates to an electrolysis cell of the single-element type design for chlor-alkali electrolysis plants, comprising an anode compartment and a cathode compartment, each of the two compartments containing an electrode connected to the rear wall of the respective compartment by means of parallel bars. The electrodes are thus subdivided into several sections. In accordance with the invention, at least one of two electrodes is provided with a curved shape in each section, this curved section protruding towards the opposite electrode and pressing a membrane area against the opposite electrode. According to a preferred embodiment, the curved shape of the various electrode sections is obtained by means of springs.

12 Claims, 5 Drawing Sheets

(56) References Cited

Figure 1:
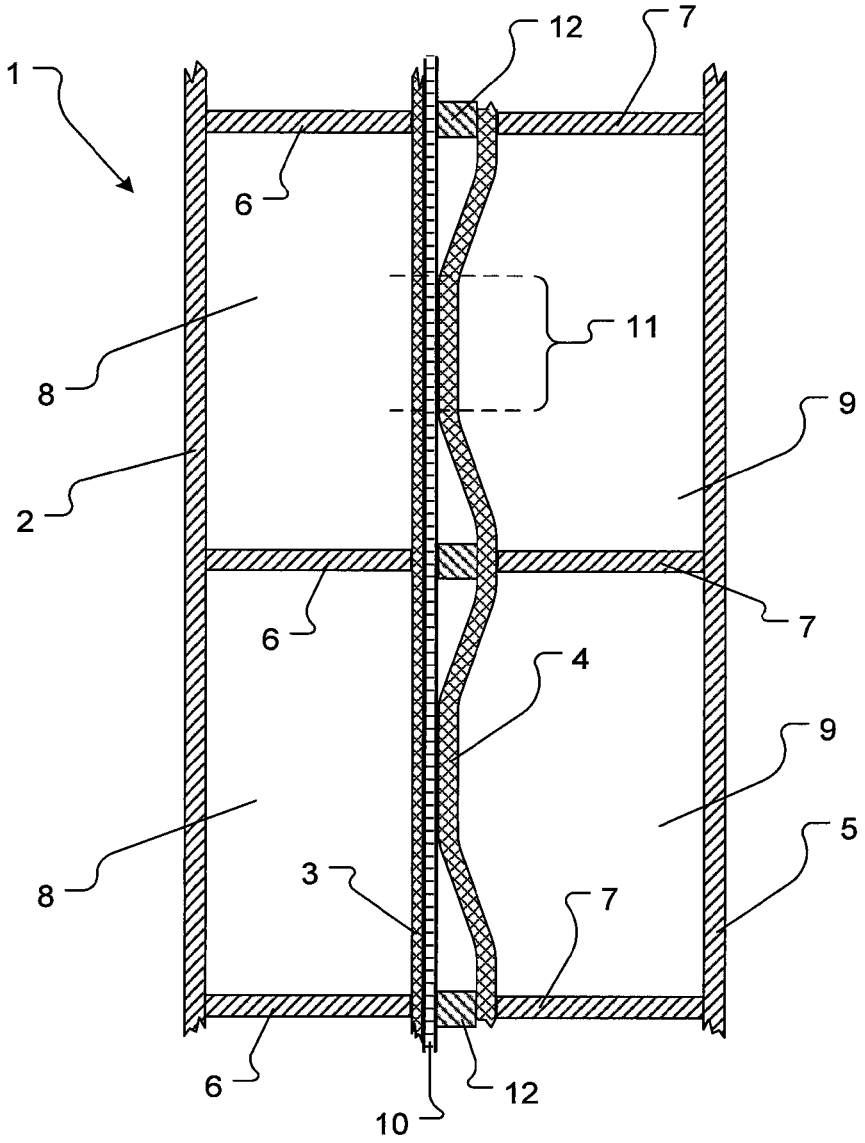

U.S. PATENT DOCUMENTS 4,789,443 A * 12/1988 deNora et al. ..... 205/513
6,495,006 B1 * 12/2002 Kimura et al. ..... 204/254
6,596,136 B1 7/2003 Gestermann
2002/0189936 A1 * 12/2002 Shimamune ..... 204/242
2003/0188966 A1 * 10/2003 Katayama ..... 204/297.14

* cited by examiner

ELECTROLYSIS CELL

This application is a 371 of PCT/EP2007/060268 filed Sep. 27, 2007

The invention relates to an electrolysis cell of the single-element type design for chlor-alkali electrolysers essentially comprised of an anode compartment and a cathode compartment, each of the two compartments being equipped with the corresponding electrode and each electrode being connected with the respective compartment rear wall by means of parallel bars. The electrodes are thus subdivided by such bars into several sections.

Chlor-alkali electrolysers of single-element type design are well known in the art and have been widely used for a variety of industrial applications. Electrolysers of such kind are for instance disclosed in DE 198 16 334 A1, DE 44 14 146 A1 or EP 0 095 039 A1.

As described in DE 10 2005 003527 A1 or DE 10 2005 006555 A1, attempts have been made at arranging the two electrodes as close as possible in a plane-parallel configuration with increasingly narrower tolerance margins. It became obvious that there were limits to said plane-parallel positioning on account of the reduced thickness required for the electrode sheets. In case the electrodes are arranged with opposed deviation from parallel, local voltage peaks are unavoidable, impairing the efficiency of the device. It is apparent how the sum of a multiplicity of small deviations eventually leads to unfavourable economics.

A very narrow electrode gap entails the additional problem of gas build-up on the periphery of the anode as described in detail in DE 10 2005 006555 A1. The gas formation causes clogging of the space between the electrode and membrane so that the electrolyte renewal is impaired. In this particular case, profiles for high-performance electrodes were developed and provided with adequate micro-structures which nevertheless did not address the problem of the very strict manufacturing tolerances required from the macroscopic point of view.

It is one object of the invention to overcome the limitations of the prior art, in particular providing an economically advantageous electrolyser suitable for minimising voltage penalties arising from constructive tolerances. This and other objects will be clarified by the following description, which shall not be intended as limiting the invention, whose extent is exclusively defined by the appended claims.

The objects of the invention are achieved by means of the electrolyser as claimed in claim 1. The electrolyser in accordance with the invention comprises an anode compartment and a cathode compartment, each compartment delimited by a rear wall provided with a peripheral rim and a peripheral flange and having an electrode arranged therein, namely an anode arranged in the anode compartment and a cathode arranged in the cathode compartment. Both electrodes are provided with a multiplicity of openings and are linked by means of parallel bars with the respective rear wall of the compartment, thereby subdividing the electrodes and their respective rear space into several sections. In accordance with the invention, each section of at least one of two electrodes has a curved portion protruding from the main plane of the electrode towards the opposite electrode, referred to the macro-structure of each electrode section. An extensive pressing of the membrane between the two electrodes can thereby take place.

In conjunction with the present invention, the term curved portion is understood to refer to a macroscopic forming or shaping of the whole portion, in contrast to the prior art technology wherein the electrode shape may present deformations in the microscopic range, for example as described in DE 10 2005 006555 A1. As the main electrode plane it is herein intended the ideal plane, parallel to the rear wall and containing the points of the electrode surface located at a minimum distance thereto.

In one preferred embodiment, the curved electrode portions are arranged in a manner to press the interposed membrane against the opposite electrode across a large area located at the two sides of the vertex line of the curved portion, the width of the pressed surface area forming at least 20% of the width of the corresponding section. It has been surprisingly found that spacing the electrodes from each other is no longer necessary if the contact surface pressure is limited in such a manner that damage to the membrane is prevented. By uncoupling the contact pressure of the membrane between the electrodes from the compressive force exerted across the parallel individual cells via the bars, it is possible to abandon the well-known plane-parallel electrode design altogether.

In one preferred embodiment of the electrolysis cell according to the invention, at least one electrode is provided with a multiplicity of curved portions parallel to each other and protruding in the same direction, whose number corresponds to the number of sections. The curved portions referred to in this context should cover at least 90% of the overall electrode height, more preferably the whole electrode height.

In one embodiment, the curved portions of the electrode define vertex lines protruding by about 0.4 to 1.0 mm from the main electrode plane in the non-assembled condition.

According to one embodiment of the invention, the shape of the curved portions of the electrode is obtained by means of at least one spring arranged in such a manner that it applies a force on the rear side of the electrode. By rear side it is herein intended the electrode side opposite the one facing the membrane.

In one embodiment, a multiplicity of double arm springs, optionally consisting of U-shaped or V-shaped springs, is arranged in the area of the bars. The springs are mounted so that the two arms are located on opposite sides of one bar, hence acting on the respective electrode so that each section of the latter is curved in the direction of the opposite electrode. In this way, the electrode itself exhibits a spring-type behaviour analogous to a leaf-spring. Such configuration presents the additional benefit that the individual spring arms to which the electrode is secured can undergo a lateral displacement whenever the contact pressure makes the longitudinal electrode edges move towards the external side.

In another embodiment, one or several springs exert a pressure in the centre of the rear side of the electrode thus curving each section in the direction of the opposite electrode. A suitable design in this case is for instance a leaf spring or L-shaped spring clamped between two bars or between the shell rim and a bar.

In another embodiment, at least one load distribution element is arranged in the respective section on the rear side of the respective electrode to be curved, said element having the shape of a rod or rail and being placed parallel to the bars in the centre of the respective section, with one or several springs exerting pressure thereon. This design has the advantage that such distribution elements can be retrofit in most electrolysers of the prior art with no substantial modification. Preferably, at least part of the load distribution elements are at least partly made of a non-conductive plastic material. The springs preferably have an open profile so that they affect the vertical circulation of the electrolyte as little as possible.

In another embodiment, the electrode does not consist of a single piece but is subdivided into a multiplicity of individual electrode segments, secured by means of springs and not via the bars. The latter in this case are merely used to transfer the compression load across the electrolysis cells arranged in parallel.

Figure 2:
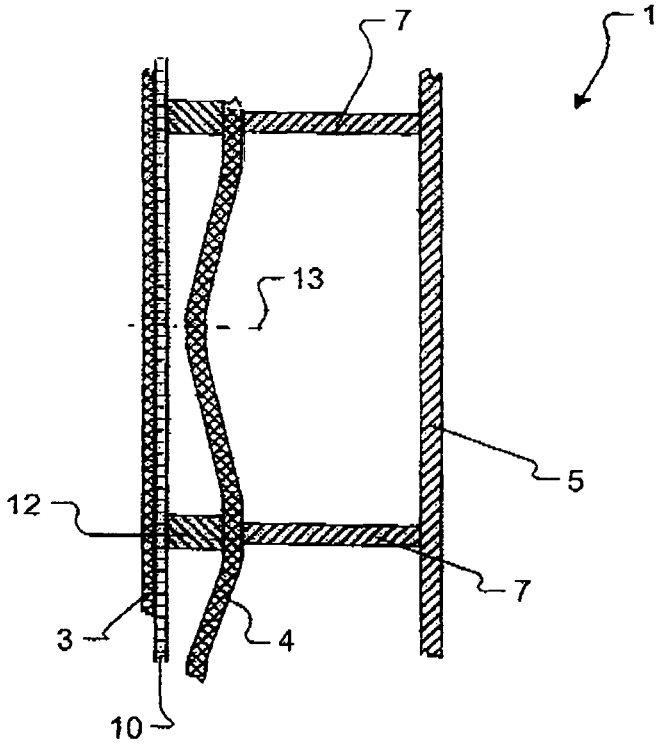
Fig. 2 PRIOR ART
Figure 3:
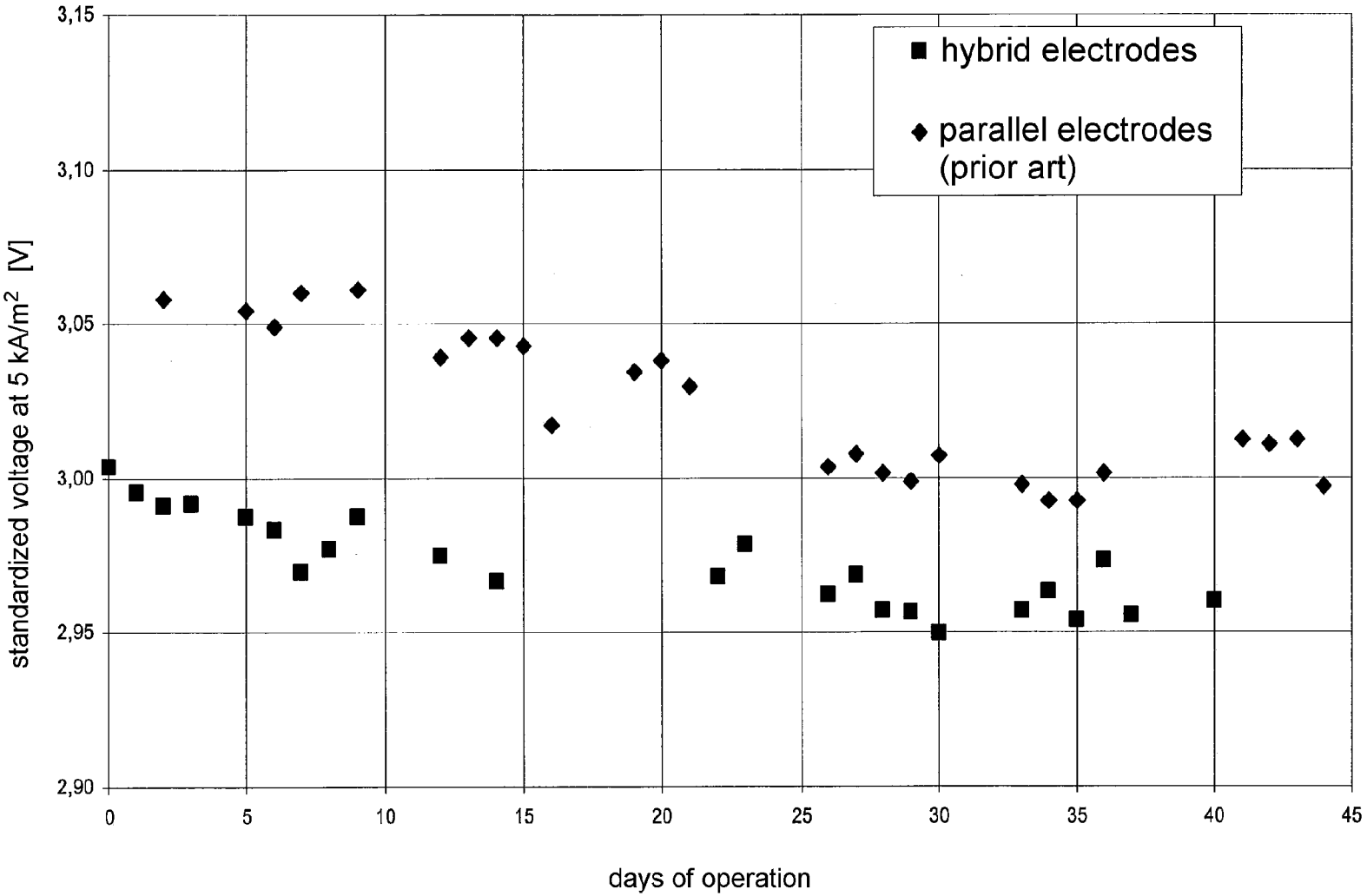
Figure 4:
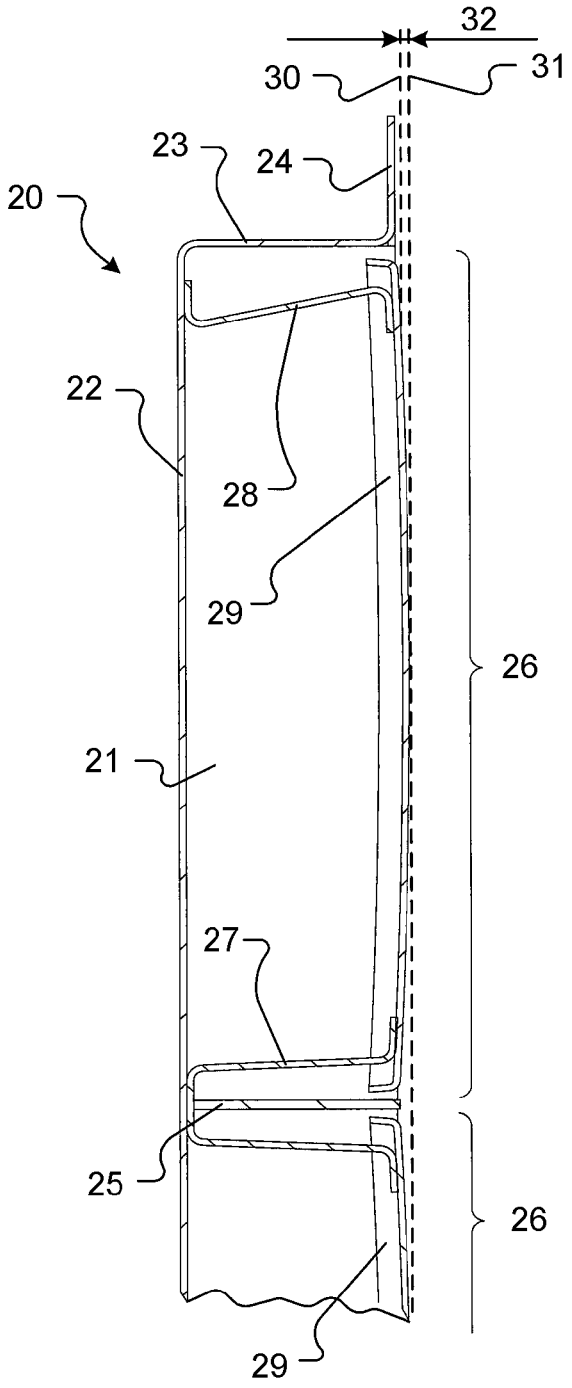
Figure 5:
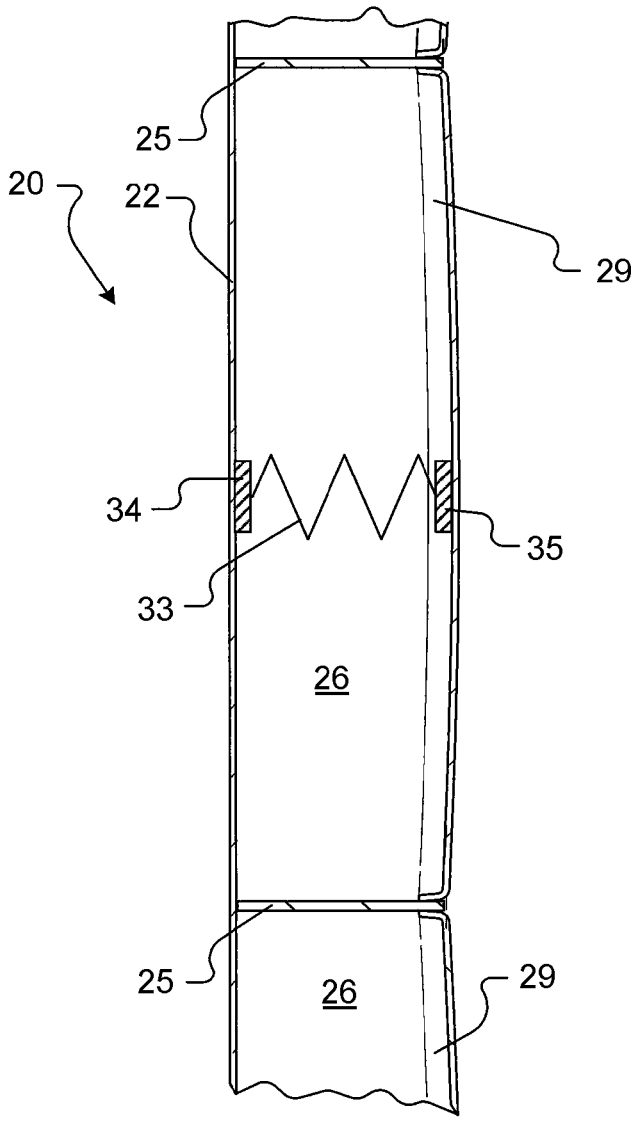

In the following, preferred embodiments of electrolysis cell of the present invention are described with reference to the annexed drawings. In the drawings:

FIG. 1 shows a first embodiment of the electrolysis cell according to the invention, FIG. 2 shows a variant of the cell of FIG. 1, FIG. 3 shows a diagram illustrating test results of the cell of FIG. 1, FIG. 4 shows a further embodiment of electrolysis cell according to the invention, FIG. 5 shows a variant of the cell of FIG. 4.

FIG. 1 illustrates a first embodiment of cell according to the invention. In the cross-sectional view of electrolysis cell (1) are shown the rear wall (2) of the cathode compartment equipped with bars (6) for fixing the cathode (3). The anode compartment has a similar design: a multiplicity of bars (7) secured to the corresponding rear wall (5) is used for fixing the anode (4). Membrane (10) is located between the two electrodes, cathode (3) and anode (4). Bars (6) and (7) also ensure a proper transmission of the compressive force once several of such electrolysis cells are assembled in parallel, mounted in a frame not shown in the drawing and put in electrical contact with each other.

FIG. 1 shows how bars (6) and (7) subdivide the respective compartment and the respective electrode into sections (8) and (9). As mentioned above, the present embodiment of electrolysis cell according to the invention shows one of the electrodes, in this case the anode (4), already pre-formed in a curved shape during the manufacturing process. In the assembly configuration shown in the drawing, anode (4) presses membrane (10) against cathode (3), wherein the width (11) of the pressed area is indicated by a brace. The electrode is pressed in a similar manner in each of parallel sections (9).

It is also shown that spacers (12) are provided in the area between opposite bars (6) and (7) as known in the art in order to restrict the extent of deformation of anode (4) during assembly.

FIG. 2 shows the sectional view of a typical electrolysis cell (1) wherein anode (4) is curved to an extent as to prevent mechanical pressing of membrane (10) against cathode (3) once installed. The position of the vertex line at the level of the plan of the drawing and perpendicular thereto is indicated by dot-dashed line (13). For the sake of an easier understanding of the drawing, the opposite section of the cathodic compartment, substantially equivalent to the one depicted in FIG. 1, is not shown in this case.

An electrolysis cell of the type shown in FIG. 1 was subjected to a series of tests and characterisations and compared with a cell in accordance with the prior art. The two cells were identical on the cathode side and the cathodes essentially consisted of flat expanded-metal sheets. The anodes of the electrolysis cell according to the invention and of the comparative one according to the prior art generally consisted of a lamellar structure. The cell of the invention was equipped with an anodic assembly of the type shown in FIG. 1, the anode being curved towards the cathode in such a manner that a large membrane area was pressed between anode and cathode. A current density of 5 $kA/m^2$ was applied to both cells. FIG. 3 is a diagram showing the test results during 45 days of operation. The electrolysis cell in accordance with the invention displayed a cell voltage about 0.05 V lower than that of the comparative cell over the whole test period.

FIG. 4 illustrates a further embodiment of electrolysis cell according to the invention. In particular, FIG. 4 shows a horizontal sectional view of the cathode compartment (21) of an electrolysis cell (20), comprising a rear wall (22), a peripheral rim or lateral wall (23) and an adjacent peripheral flange (24). Bars (25), which transfer the compression load across the individual cells arranged in parallel during operation, subdivide the compartment into vertical sections (26). The anode compartment, not shown in the drawing, may have a substantially equivalent design. Cathodic segment (29) is secured to U-type spring (27) and Z-type spring (28). Z-type spring (28) is merely positioned along lateral wall (23), whereas cathodic segments (29) are fastened to two identical U-type springs (27) inside the cathode compartment. The cathode compartment is shown in a state prior to assembly and clearly illustrates the maximum curving of cathodic segment (29). Dashed line (30) marks the zero position in the absence of curving, whereas dashed line (31) indicates the height of the vertex line with distance (32) from zero position (30).

FIG. 5 shows the sectional view of another embodiment of electrolysis cell (20) in accordance with the present invention. The cathode compartment is similar to the embodiment shown in FIG. 4, but cathodic segments (29), secured to two adjacent bars (25), are curved by means of a spring (33) placed in the centre of section (26). Spring (33) in this case is sketched as a spiral spring (33), but other equivalent solutions can be provided as it will be evident to one skilled in the art. Spiral spring (33) is clamped between lower pad (34) and upper pad (35) to ensure a uniform transfer of forces.

The previous description shall not be intended as limiting the invention, which may be practised according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements or additives.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. An electrolysis cell of single-element type design for chlor-alkali electrolysis comprising:

an anode compartment and a cathode compartment, each delimited by a rear wall, each of said two compartments having a corresponding electrode arranged therein consisting of an anode being arranged in said anode compartment and a cathode being arranged in said cathode compartment;

a membrane arranged between the electrodes, each of said electrodes being connected with the rear wall of the respective compartment by means of parallel bars, said bars subdividing the corresponding electrode into multiple sections, each section having at least one of the electrodes in a pre-formed curved shape such that the curved portion is protruding towards the opposite electrode and defining a vertex line, the pre-formed curved shaped electrode is arranged so as to press an area of the membrane against the opposite electrode, the area being a width running on two sides of the vertex line and being at least 20% of the width of said section, wherein the number of said curved portions coincides with the overall number of sections of the corresponding cell compartment.

2. The electrolysis cell of claim 1, wherein said curved portions cover at least 90% of the overall electrode height.

3. The electrolysis cell of claim 1, wherein the vertex lines of the curved portions protrudes by about 0.4 to 1.0 mm from the main electrode plane in the non-assembled condition.

4. An electrolysis cell of single-element type design for chlor-alkali electrolysis comprising:

an anode compartment and a cathode compartment, each delimited by a rear wall, each of said two compartments having a corresponding electrode arranged therein consisting of an anode being arranged in said anode compartment and a cathode being arranged in said cathode compartment;

a membrane arranged between the electrodes, each of said electrodes being connected with the rear wall of the respective compartment by means of parallel bars, said bars subdividing the corresponding electrodes into multiple sections, at least one of the electrodes in each section having a curved shape such that the curved portion is protruding towards the opposite electrode and defining a vertex line, wherein the curved shape of the curved portion is obtained by at least one spring running perpendicularly with respect to the length of said electrode, from the rear wall to the electrode and acting on the electrode rear side so as to press an area of the membrane against the opposite electrode, the area being a width running on two sides of the vertex line and being at least 20% of the width of said section.

5. The electrolysis cell of claim 4, wherein said at least one spring is provided with two arms, said two arms being located on opposite sides of one of said parallel bars.

6. The electrolysis cell of claim 5, wherein said spring is U-shaped or V-shaped.

7. The electrolysis cell of claim 4, wherein said at least one spring exerts a pressure in the center of at least one of said electrode sections.

8. The electrolysis cell of claim 7, wherein said springs are leaf-springs or L-shaped springs clamped between two of said parallel bars or between a peripheral rim and one of said parallel bars.

9. The electrolysis cell of claim 4, wherein at least one load distribution element is arranged in each of said electrode sections, said element being shaped as a rod or rail and being positioned parallel to the bars in the centre of the corresponding electrode section thereby further dividing each of said electrode sections into subsections, said element running from the rear wall to the electrode, with at least one spring exerting pressure in said subsections.

10. The electrolysis cell of claim 9, wherein said at least one load distribution element is at least partly made of a non-conductive material.

11. The electrolysis cell of claim 9, wherein said at least one spring is open to the vertical electrolyte flow.

12. An electrolysis cell of single-element type design for chlor-alkali electrolysis comprising:

an anode compartment and a cathode compartment, each delimited by a rear wall, each of said two compartments having a corresponding electrode arranged therein consisting of an anode being arranged in said anode compartment and a cathode being arranged in said cathode compartment;

a membrane arranged between the electrodes, each of said electrodes being connected with the rear wall of the respective compartment by means of parallel bars, said bars subdividing the corresponding electrode into multiple sections, each section having at least one of the electrodes in a pre-formed curved shape such that the curved portion is protruding towards the opposite electrode and defining a vertex line, the pre-formed curved shaped electrode is arranged so as to press an area of the membrane against the opposite electrode, the area being a width running on two sides of the vertex line and being at least 20% of the width of said section, wherein there is one curved portion per section in the corresponding cell compartment.

* * * * *